US006023791A

United States Patent [19]

Chiang

[11] Patent Number: 6,023,791

[45] Date of Patent: Feb. 15, 2000

[54] SWIMMING GOGGLE STRUCTURE

[76] Inventor: Herman Chiang, 11F, #634-9, Ching-Ping Rd., Chung-Ho, Taipei City, Taiwan

[21] Appl. No.: 08/805,306

[22] Filed: Feb. 25, 1997

[51] Int. Cl.[7] ..... A61F 9/02

[52] U.S. Cl. ..... 2/441; 2/444; 2/445

[58] Field of Search ..... 2/426, 439, 440, 2/441, 442, 443, 444, 445, 427, 428, 452, 446

[56] References Cited

U.S. PATENT DOCUMENTS

| | | | |
|---|---|---|---|
| 2,682,196 | 6/1954 | Baldanza et al. | 2/446 |
| 4,755,040 | 7/1988 | Haslbeck | 2/428 |
| 5,459,882 | 10/1995 | Yamamoto | 2/452 |
| 5,515,551 | 5/1996 | Yashiro | 2/452 |
| 5,524,300 | 6/1996 | Chiang | 2/452 |

*Primary Examiner*—C. D. Crowder
*Assistant Examiner*—Larry D. Worrell, Jr.
*Attorney, Agent, or Firm*—Pro-Techtor International

[57] ABSTRACT

A swimming goggle structure includes a pair of lens-rim members each of which is composed of a lens with a rim integrally extending from and circumferentially surrounding the lens, the rim having a rim face extending from the lens and a rim flange extending from the rim face with the a right-angled structure defined between the rim face and the rim flange. A padding member associated with each of the lens-rim members has a closed ring like enclosure section to rest on the rim face with the rim flange received with a slot formed on inside surface of the enclosure section and a face contact section integrally extending from the enclosure section to be in contact engagement with a wearer's face. A bridge connects the lens-rim members to each other. A strap has two opposite ends respectively connected to the remote edges of the padding members. The enclosure section of the padding member has a triangular cross section resting on and engage the rim face and the rim flange so as to prevent the padding member from disengaging from the lens-rim member in putting on the swimming goggles.

7 Claims, 10 Drawing Sheets

SWIMMING GOGGLE STRUCTURE

FIELD OF THE INVENTION

The present invention relates generally to a swimming goggle structure and in particular to a swimming goggle in which the goggle frame and the lenses are made integral with each other, while a cushion pad forming a portion of the frame encloses and is thus securely mounted to the frame.

BACKGROUND OF THE INVENTION

Swimming goggles with integrated frame and lenses that is related to the swimming goggle structure to be improved by the present invention is shown in FIG. 1. Such a conventional swimming goggle structure, designated with reference numeral 6 in the drawings, comprises two rims 60, two lenses 61, two padding members 62, a bridge 63 and a strap 64. Each of the rims 60 has a lens 61 associated therewith and the rim 60 and the lens 61 are made integrally with a rigid, light transmitting material. The rim 60 has a circumferential flange 601 formed thereon to which the associated padding member 62 is mounted.

The rim 60 has a connecting section 602 formed at an inner side thereof to be connected to the other rim 60 by the bridge 63. The rim 60 also has a strap connector ring 603 for connecting the strap 64.

The padding member 62 is made of a soft material, having a circumferential lip 621 to engage the flange 601 of the rim 60 and a face contact section 622 integral with the lip 621 to provide a comfortable and compliant contact with the face of a wearer.

Referring to FIGS. 2A and 2B, conventionally the padding member 62 is mounted to the flange 601 of the rim 60 by means of the lip 621. Such an engagement between the flange 601 of the rim 60 and the lip 621 of the padding member 62 is, however, not very firm which may sometimes leads in disengagement therebetween when a user puts on the goggles in a harsh manner.

As shown in FIG. 2B, the lip 621 of the padding member 62 has a J-shaped cross section having a short leg 6210 and a long leg 6211 with a space formed therebetween, defining a receiving slot 620 to receive and hold therein the flange 601 of the rim 60 in such a manner that the short leg 6210 is located on the side (outer side) of the flange 601 that is away from the wearer's face, while the long leg 6211 is located on the side of the flange 601 that is confronting the wearer's face (inner side) and integrally connected to the face contact section 622.

In putting on the swimming goggles, the wearer may sometimes need to adjust the location of the swimming goggles on the face by moving the goggles for example up and down and in moving the goggles up and down, due to the contact engagement between the face contact section of the padding member 62 and the wearer's face, a drag force is imposed on the face contact section 622 of the padding member 62 by the wearer's face, as indicated by the straight arrows of Figure 2B. This causes the short leg 6210 of the lip 621 to turn over the flange 601 of the rim 60 as indicated by the arc arrows of FIG. 2B for the padding member 62 is made of a soft material. Such a situation often leads in disengagement of the padding member 62 from the rim 60 in wearing the swimming goggles.

In view of such a drawback, an improvement of the swimming goggles is made in accordance with the present invention to eliminate such a problem.

SUMMARY OF THE INVENTION

Therefore, the principal object of the present invention is to provide a swimming goggle structure of the type of which the lenses and the rims are integrally formed as single pieces, wherein the engagement between the padding members and the rims are provided not only by having the flange of the rim received within the slot provided on the padding member, but also by providing the padding member with an extension of large cross section to overlap and circumferentially enclose the rim so as to more securely retain the padding member on the lens-rim structure.

Another object of the present invention is to provide an improved swimming goggle structure in which the rim enclosure of the padding may be provided with varied decorative designs for aesthetic purpose.

To achieve the above objects, the present invention provides an improved swimming goggle structure of the type having a unitary lens-rim structure composed of a lens and a rim wherein the rim comprises a rim face extending from the lens and a rim flange extending from the rim face and wherein the padding member comprises a closed ring like enclosure to engage the rim flange and rest on and surround and circumferentially enclose the rim face of the rim so that by means of the tight engagement between the enclosure section of the padding member and the rim face of the rim of the lens-rim member, the padding member is securely fixed on the lens-rim member.

In accordance with the present invention, the rim face and the rim flange of the rim define a right-angled configuration which matches the "least mold removal angle" of the lens-rim member and the padding member comprises a circumferentially extending slot formed on an inside surface thereof for receiving and holding the rim flange therein in such a manner to have the enclosure section securely rest on the rim face to circumferentially enclose the rim face and to cover a circumferential edge of the lens.

In accordance with another aspect of the present invention, a lens retainer means is provided to more securely retain the lens-rim member on the padding member.

In accordance with a further aspect of the present invention, the lens retainer means is provided on two opposite edges of the lens-rim member, comprising extensions from the rim and corresponding recess formed on the padding member to receive and hold the extension therein.

BRIEF DESCRIPTION OF THE DRAWINGS

The present invention will be better understood from the following description of preferred embodiments thereof with reference to the attached drawings, wherein.

DETAILED DESCRIPTION OF THE PREFERRED EMBODIMENTS

Figure 3:
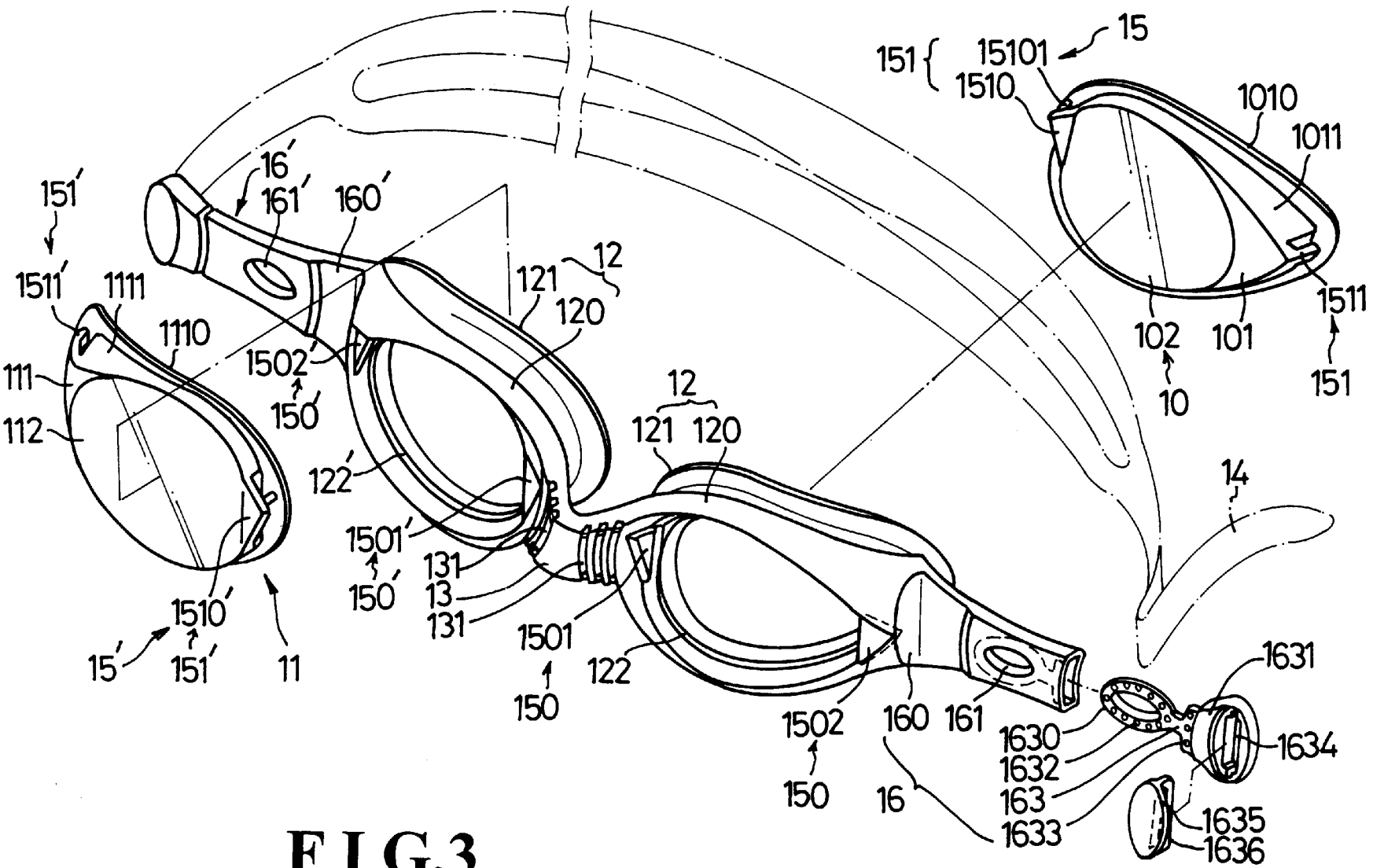
FIG. 3 is an exploded perspective view showing a swimming goggle structure in accordance with a first embodiment of the present invention.

With reference to the drawings and in particular to FIG. 3, which shows a swimming goggle structure in accordance with a first embodiment of the present invention, generally designated with reference numeral 1, the swimming goggle structure of the present invention comprises a pair of lens-rim members 10 and 11 each of which comprises a lens portion 102, 112 and a rim portion 101, 111 integrally formed with and circumferentially surrounding the respective lens 102, 112, a padding member 12, 12' associated with each of the two lens-rim members 10 and 11, a bridge 13 connecting between proximal edges of the padding members 12 and 12' (and also the lens-rim members 10 and 11) and a strap 14 releasably and adjustably connecting between remote edges of the padding members 12 and 12'.

The swimming goggle structure 1 also comprises means for preventing the bridge 13 from being stretched which comprises an anti-stretching member 16, 16' attached to the remote edge of each of the padding members 12 and 12' and having a strap fastener for releasably engaging one of two opposite ends of the strap 14.

Each of the lens-rim members 10 and 11 is provided with lens retainer means 15, 15' to retain the lens-rim members 10 and 11 on the padding members 12 and 12'.

The lens-rim members 10 and 11, which as mentioned above are each composed of a lens portion 102, 112 and a rim portion 101, 111 circumferentially surrounding the respective lens 102, 112, are preferably made of a rigid and transparent (light transmitting) material. Each of the rims 101 and 111 has a rim face 1011 or 1111 perpendicularly extending from the lens 102, 112 and circumferentially surrounding the lens 102, 112 and a circumferential rim flange 1010, 1110 which extends from the rim face 1011, 1111 in a substantially perpendicular manner and is substantially parallel with the lens 102, 112 so as to define a right-angled structure. In other words, the configuration of the rim portion 101, 111, particularly the rim face 1011, 1111, is designed to match the "least mold removal angle" of the lens-rim member 10, 11.

Each of the padding members 12 and 12' is composed of a closed ring like enclosure section 120, 120' and a face contact section 121, 121' defining therebetween a receiving slot 122, 122' for receiving and holding therein the rim flange 1010, 1110 of the respective rim 101, 111 in such a manner to have the enclosure section 120, 120' resting on and in tight contact engagement with the rim face 1011, 1111 and thus enclosing and covering the circumferential edge of the lens portion 102, 112.

Figure 4A:
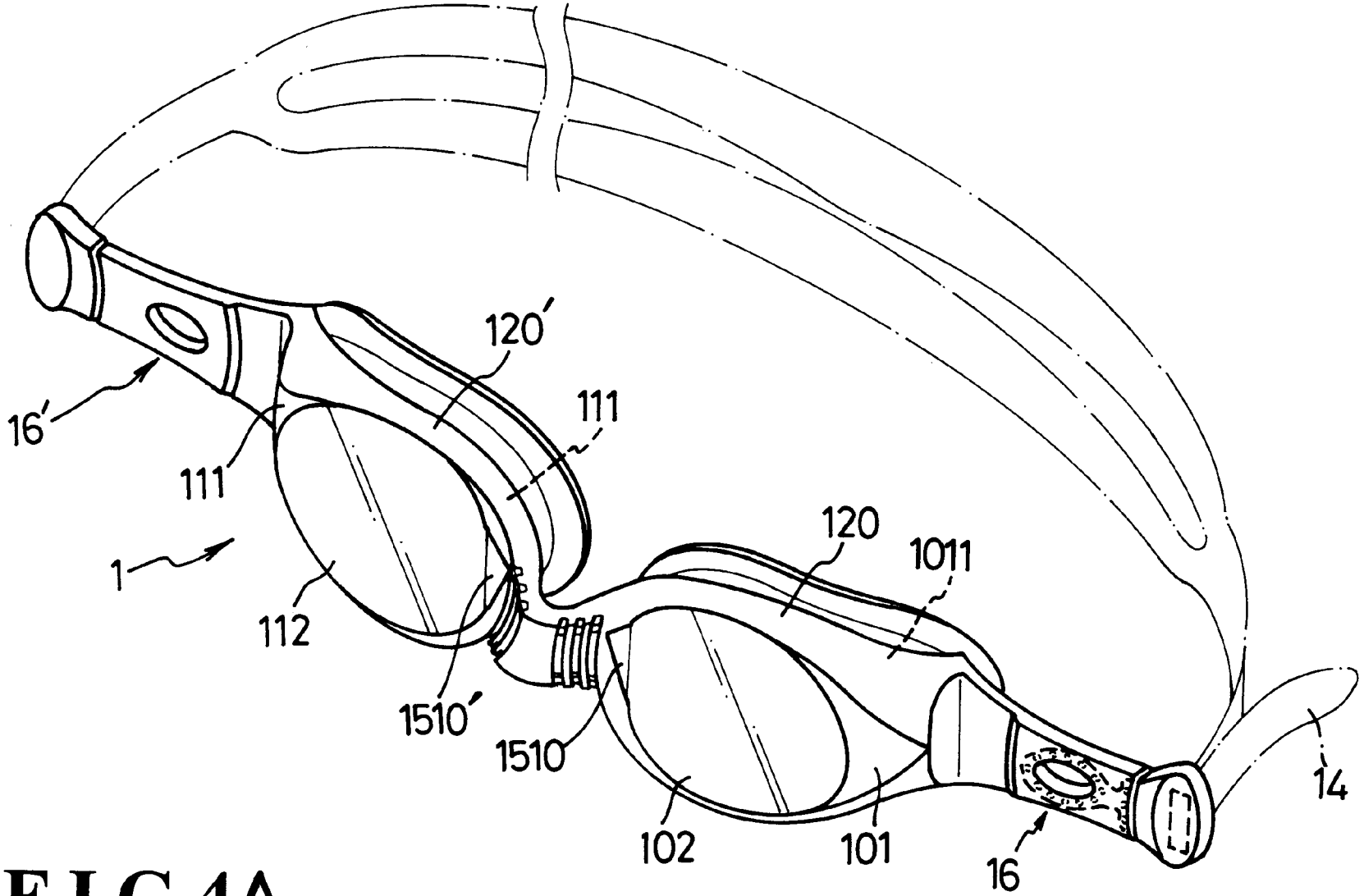
FIGS. 4A and 4B are perspective view and cross-sectional view, respectively, of the first embodiment swimming goggle structure of the present invention.
Figure 4B:
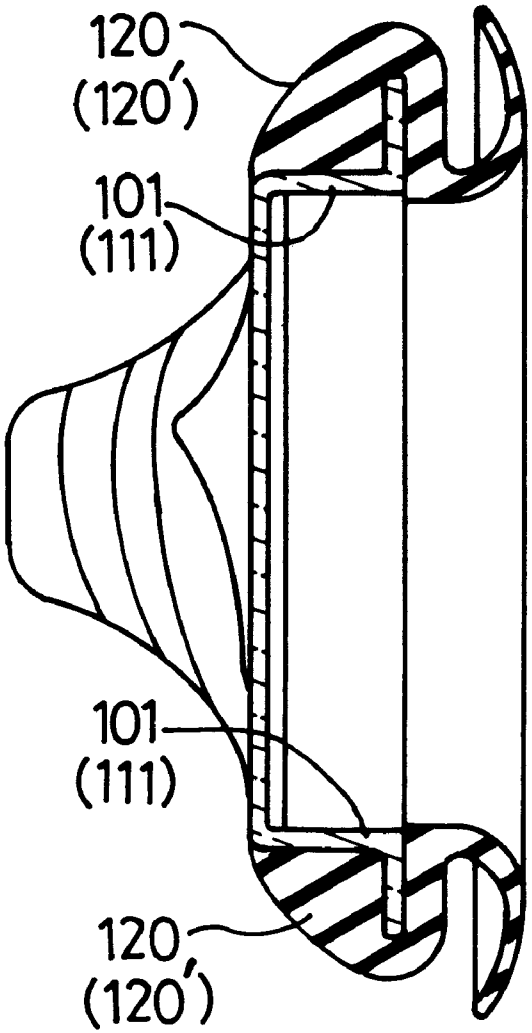

To accommodate the right-angled arrangement between the rim flange 1010, 1110 and the rim face 1011, 1111 of the rim portion 101, 111, the enclosure section 120, 120' of the padding member 12, 12' has a cross section that is very close to a right-angled triangle with the two perpendicular sides thereof respectively resting against the rim face 1011, 1111 and the rim flange 1010, 1110 and the third side thereof extending from the top of the rim flange 1010, 1110 to the circumferential edge of the lens 102, 112 to cover the circumferential edge, as shown in FIG. 4B.

Each of the anti-stretching members 16 and 16' that is mounted to the remote edge of the padding members 12, 12' comprises a length extending from the respective enclosure section 120, 120'. The length of the anti-stretching member 16, 16' is divided into a front section 160, 160', an intermediate section 161, 161' and a rear section 163, 163'. The front section 160, 160' extends from the respective enclosure section 120, 120' of the padding member 12, 12' and preferably has an arc configuration, from which the intermediate section 161, 161' extends away from the padding members 12, 12'. The intermediate section 161, 161' comprises a hole, preferably an oval hole, formed thereon. The rear section 163, 163' of the anti-stretching member 16, 16' is made of a rigid material and is connected to the intermediate section 161, 161' to connect the strap 14 to the padding member 12, 12'.

The rear section 163, 163' of the anti-stretching member 16, 16 comprises an oval portion 1630 to be received within a bore formed on the intermediate section 161, 161' and extending along the intermediate section 161, 161' toward the front section 160, 160'. The oval portion 1630 of the rear section 163, 163' comprises an oval hole corresponding to the oval hole of the respective intermediate section 161, 161' and aligned with the oval hole of the intermediate section 161, 161' when the oval portion 1630 of the rear section 163, 163' is received within the bore of the intermediate section 161, 161'. The oval portion 1630 comprises a plurality of apertures or passages 1632 which allow material that forms the intermediate section 161, 161' to flow therethrough in molding the intermediate section 161, 161', together with the front section 160, 160' and the padding member 12, 12'. The material that is used to mold the intermediate section 161, 161', after cured, is kept within the passages 1632 and thus securely fixes the rear section 163, 163' to the intermediate section 161, 161'.

The rear section 163, 163' also comprises a coupling portion 1631 having a slot 1634 formed thereon to removably receive therein a securing button 1635. The securing button 1635 comprises a plate portion receivable within the slot 1634 of the coupling portion 1631 and an expanded top portion to retain the plate portion within the slot 1634. The plate portion of the securing button 1635 has a through hole 1636 formed thereon through which the end of the strap 14 is receivable. The coupling portion 1631 of the rear section 163, 163' and the securing button 1635 constitute a strap fastener which is used to secure the strap 14 to the padding members 12 and 12' via the anti-stretching members 16 and 16'.

In securing the strap 14 to the anti-stretching member 16, 16', the end of the strap 14 that is received within the hole 1636 of the securing button 1635 is folded back over the coupling portion 1631 and inserted into the slot 1634 to securely couple to the coupling portion 1631 of the anti-stretching member 16, 16'.

The bridge 13 is integrally connected to the proximal edge of each of the padding members 120 and 120' and comprises a fluted front side having a plurality of flutes 131 which extend in a direction substantially normal to the direction of the bridge 13 that extends between the two padding members 12 and 12' to provide the bridge 13 with a better flexibility in conformity with the face contour of the wearer.

The face contact section 121, 121' of the padding member 12, 12' extends from the inner edge of the inner side of the enclosure section 120, 120' and spaced from the inner side of the enclosure section 120, 120' to define a soft and resiliently deformable portion that is to be engaged by the wearer's face. The softness and resilient deformability of the face contact section 121, 121' provide a comfortable contact engagement with the wearer's face and a better compliance with the contour of the wearer's face. Thus, it is quite obvious and should be noted that the padding members 12 and 12', the bridge 13 and the front sections 160, 160' and the intermediate sections 161 and 161' are made of a soft or resilient material and are formed as a single piece preferably by means of molding.

The lens retainer means 15, 15' comprises female means 150, 150' provided on the enclosure section 120, 120' of the padding member 12, 12' and male means 151, 151' provided on the rim 101, 111 which mates the female means 150, 150'. The female means 150, 150' comprises an inner female means located at the proximal edge of the respective padding member 12, 12' and an outer female means located at the remote edge of the padding member 12, 12', the inner and outer female means being different in structure, but providing the same function of retaining the lens-rim structure 10, 11 within the padding member 12, 12'. Correspondingly, the male means 151, 151' comprises inner and outer male means located at two opposite edges of the respective lens-rim structure 10, 11 to correspond to and engage with the inner and outer female means of the padding members 12, 12'.

The inner male means of the male means 151, 151' comprises an extension 1510, 1510', preferably triangular in shape, from the proximal edge of the rim 101, 111 with a peg 15101, 15101' extending therefrom toward the rim flange 1010, 1110 of the rim 101, 111. The inner female means of the female means 150, 150', correspondingly, comprises a triangular recess for receiving the triangular extension 1510, 1510' therein and a bore 1501, 1501' corresponding to the peg 15101, 15101' is formed in the recess to receive the peg 15101, 15101'.

The outer male means of the male means 151, 151' comprise an extension 1511, 1511' to be received within a channel-like opening 1502, 1502' formed on the padding member 12, 12' and thus enclosed in the opening 1502, 1502'. The channel-like opening 1502, 1502' constitutes the outer female means of the female means 150, 150'. By means of the engagement between the male means 151, 151' of the lens-rim member 10, 11 and the female means 150, 150' of the padding member 12, 12', the lens-rim member 10, 11 is securely retained within the padding member 12, 12'.

Figure 1:
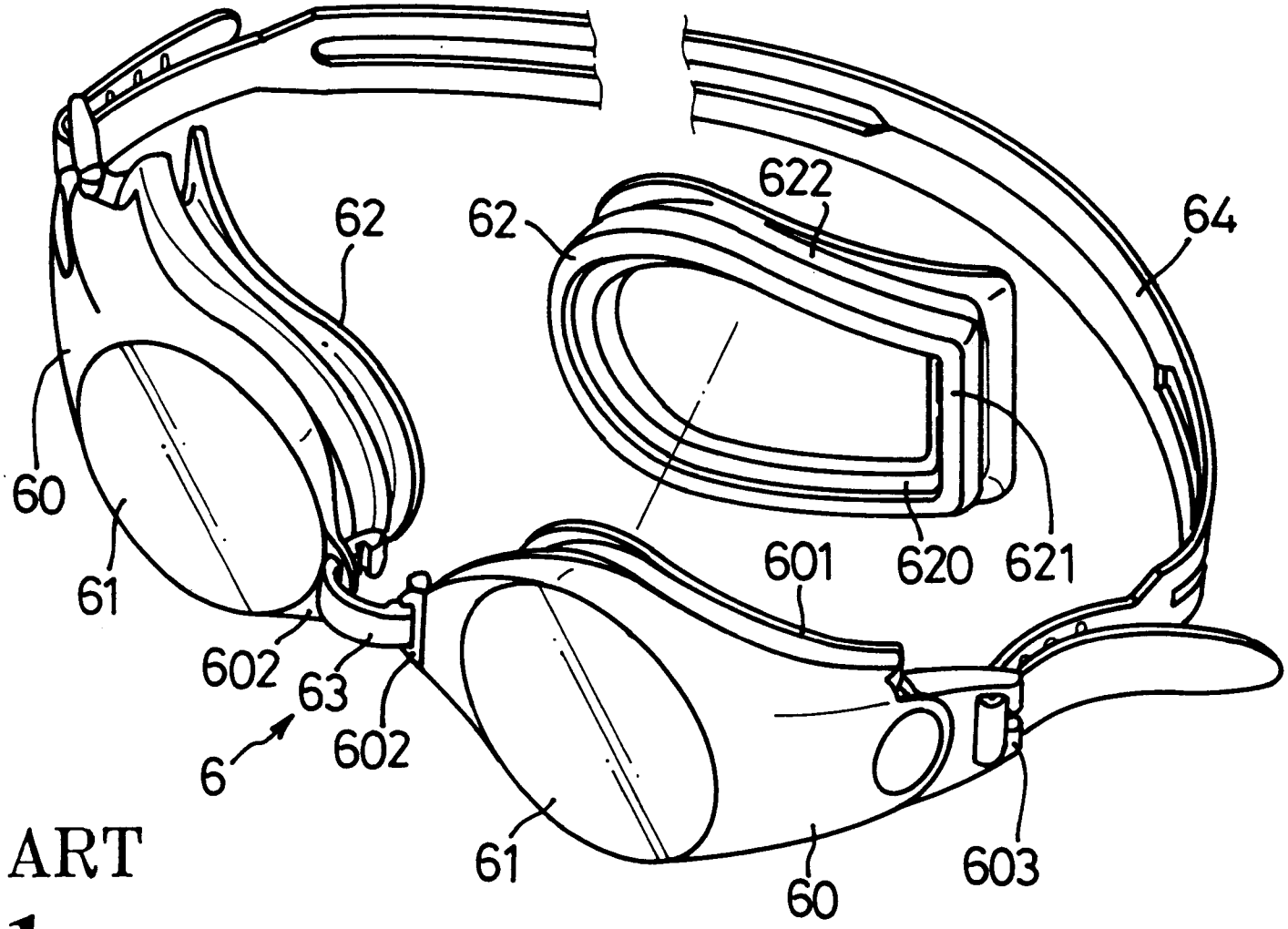
PRIOR ART FIG.1
FIG. 1 is a perspective view of a pair of conventional swimming goggles of the type having a unitary lens-rim structure, wherein a padding member is detached from the lensrim structure.
Figure 2A:
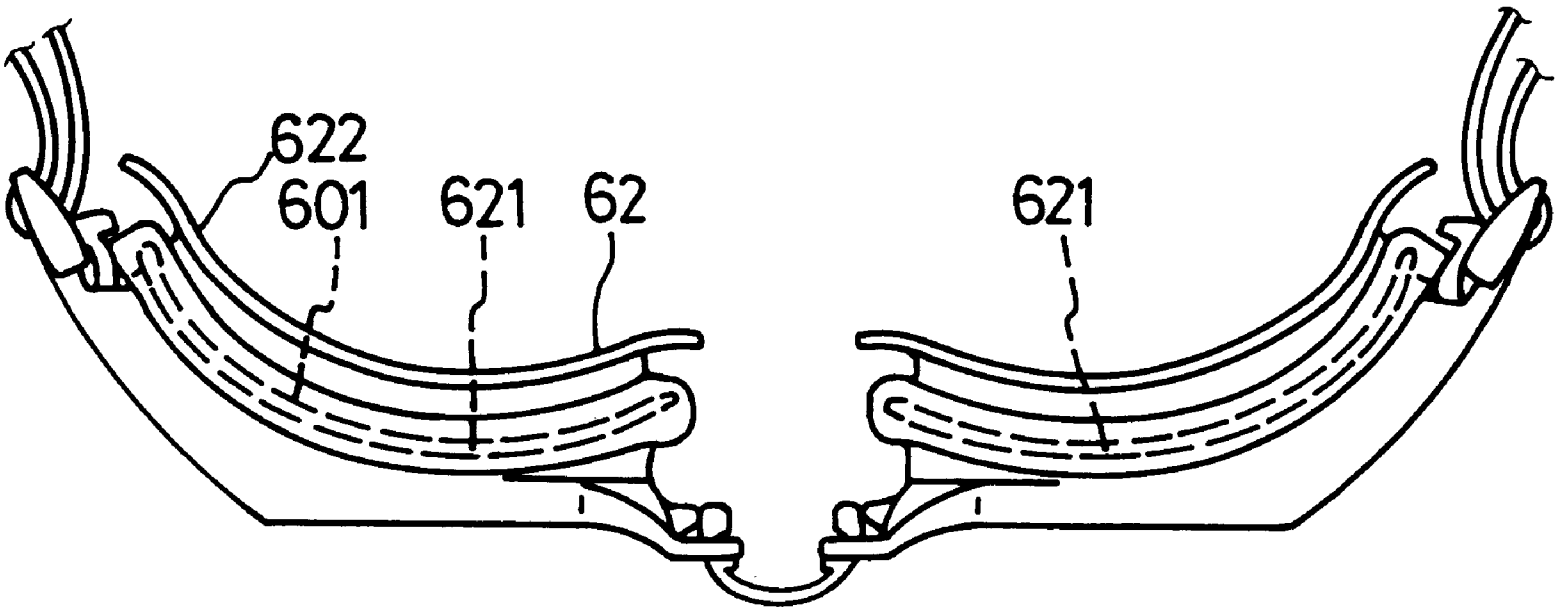
PRIOR ART FIG.2A
FIGS. 2A and 2B are top view and cross-sectional view of the conventional swimming goggles shown in FIG. 1.
Figure 2B:
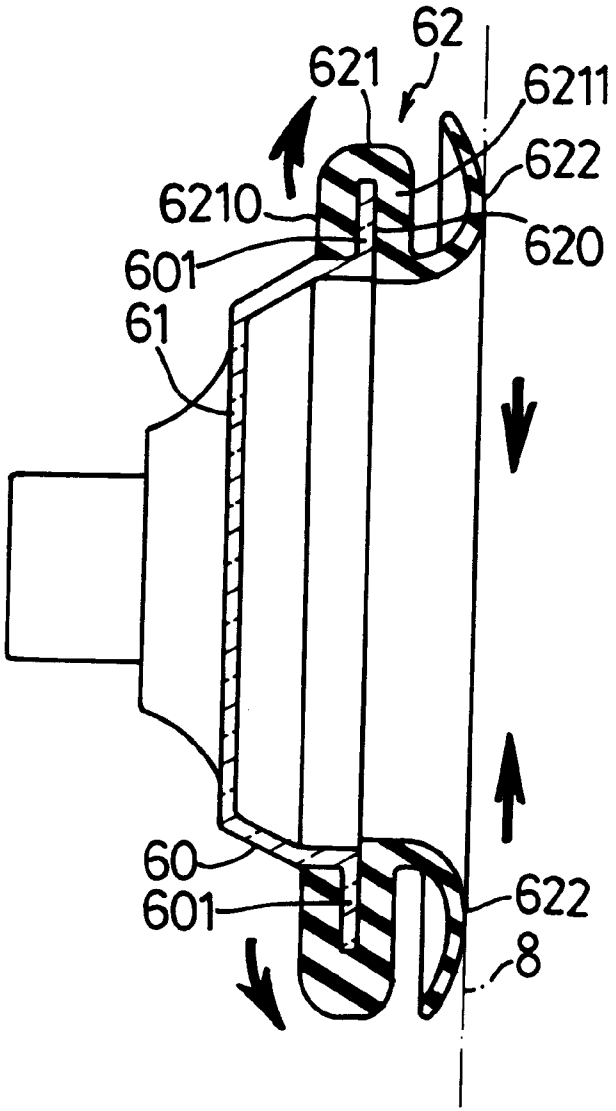
PRIOR ART FIG.2B

Referring to FIG. 4A, which shows a perspective view of the swimming goggle structure in accordance with the first embodiment of the present invention, it can be observed from the drawing that the enclosure section 120, 120' of the padding member 12, 12' completely surrounds and circumferentially encloses the rim face 1011, 1111 of the rim 101, 111 of the lens-rim member 10, 11 and as shown, the circumferential edge of the lens 102, 112 of the lens-rim member 10, 11 is also covered by the enclosure section 120, 120' of the padding member 12, 12'. This arrangement makes the rim face that is exposed outside the material of the padding in the prior art design (see FIGS. 1, 2A and 2B) now completely covered by the enclosure section 120, 120' of the padding member 12, 12' so that the enclosure section 120, 120' may be regarded as an "integral" portion of the rim 101, 111 of the lens-rim member 10, 11. Of course, the padding member 12, 12' and the associated lens-rim member 10, 11 is now more sound and firmly fixed together.

In addition, the triangular extension 1510, 1510' and streamlined profile of the rim 101, 111 make the overall configuration of the lens-rim member 10, 11 more fashionable and thus more attractive to the consumers. The enclosure sections 120 and 120' provide an outer surface which allows the manufacturers of the swimming goggles to add any desired decorative patterns or designs.

Referring to FIG. 4B, in adjusting the location of the swimming goggles 1 on the face of the wearer, when the wearer moves the goggles 1 in the up and down direction, due to the right-angled triangular cross section of the enclosure section 120, 120' of the padding member 12, 12' and the right-angled arrangement of the rim face 1011, 1111 and the rim flange 1010, 1110 of the rim 101, 111 which provides a more secured and firm engagement between the padding member 12, 12' and the rim 101, 111 of the lens-rim member 10, 11 that is quite different from the prior art design, the drag force imposed on the padding members 12 and 12' caused by the movement of the swimming goggles 1 on the wearer's face is not likely to disengage the padding members 12 and 12' from the rims 101 and 111 of the lens-rim members 10 and 11.

Figure 5:
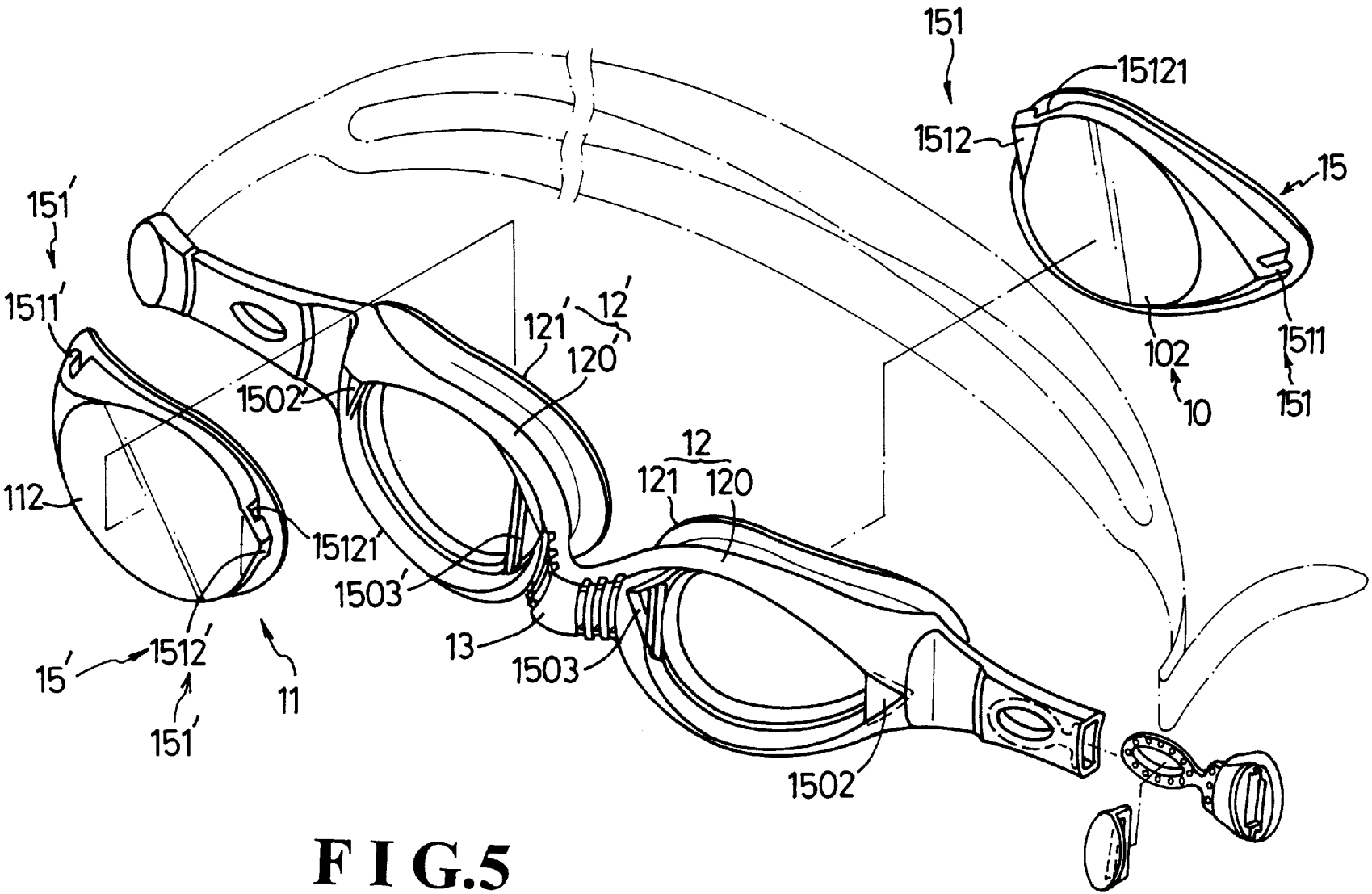
FIG. 5 is an exploded perspective of the swimming goggle structure of the present invention incorporating a strap fastener of another embodiment.

Referring to FIG. 5, which show a variation of the lens retainer means 15, 15' in accordance with the present invention, in the embodiment illustrated in FIG. 5, the inner male means of the male means 151, 151' comprises an extension 1512, 1512', preferably triangular in shape, having a slot 15121, 15121' formed thereon and correspondingly, the inner female means of the female means that is provided on the padding member 12, 12' comprises a recess 1503, 1503' into which the extension 1512, 1512' is tightly received. Such an arrangement may also be provided on the remote edge of the padding member 12, 12' so as to have the lens-rim member 10, 11 securely fixed to the padding member 12, 12'.

Figure 6:
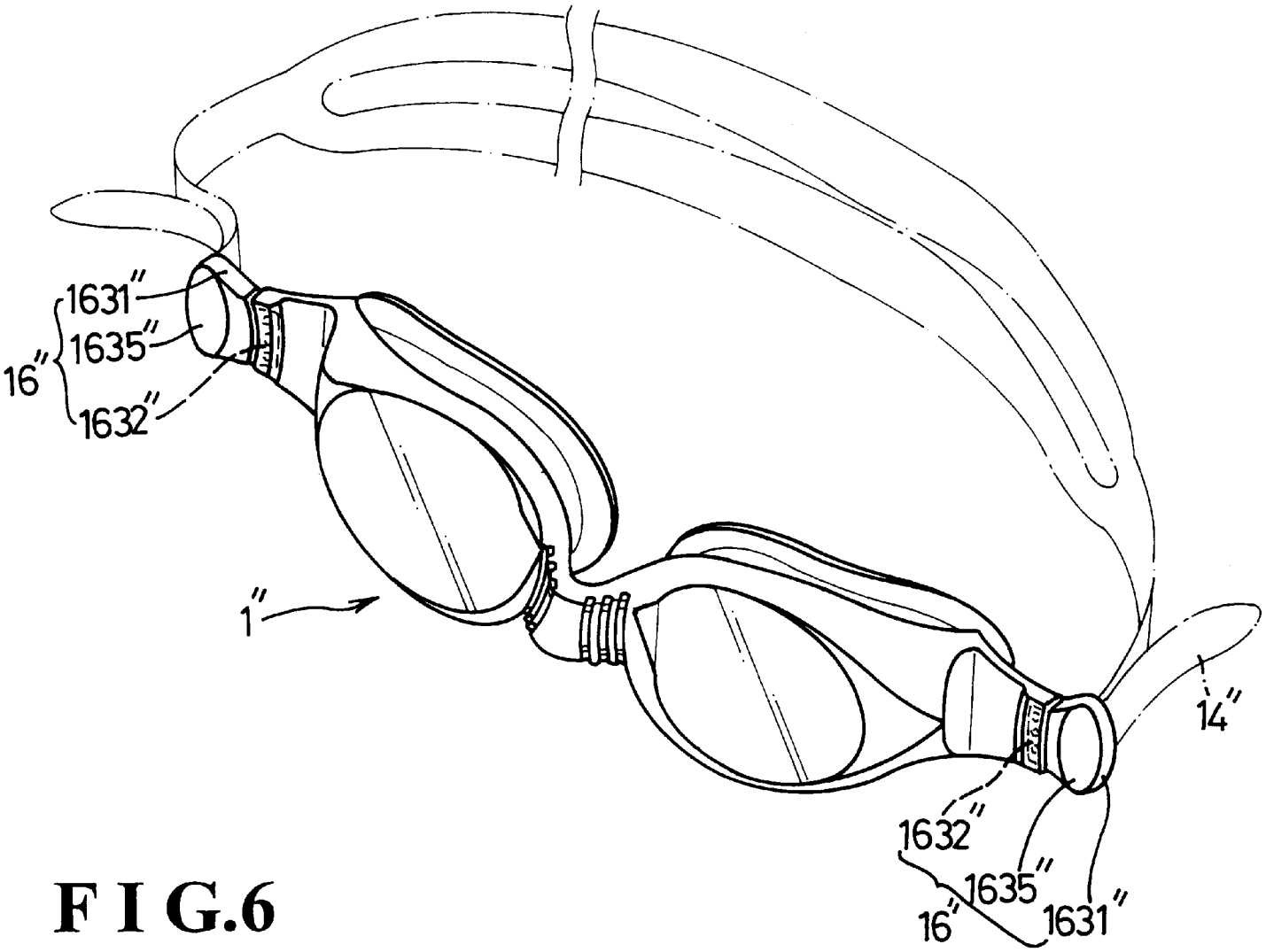
FIG. 6 is a perspective view showing a swimming goggle structure in accordance with a further embodiment of the present invention.
Figure 7:
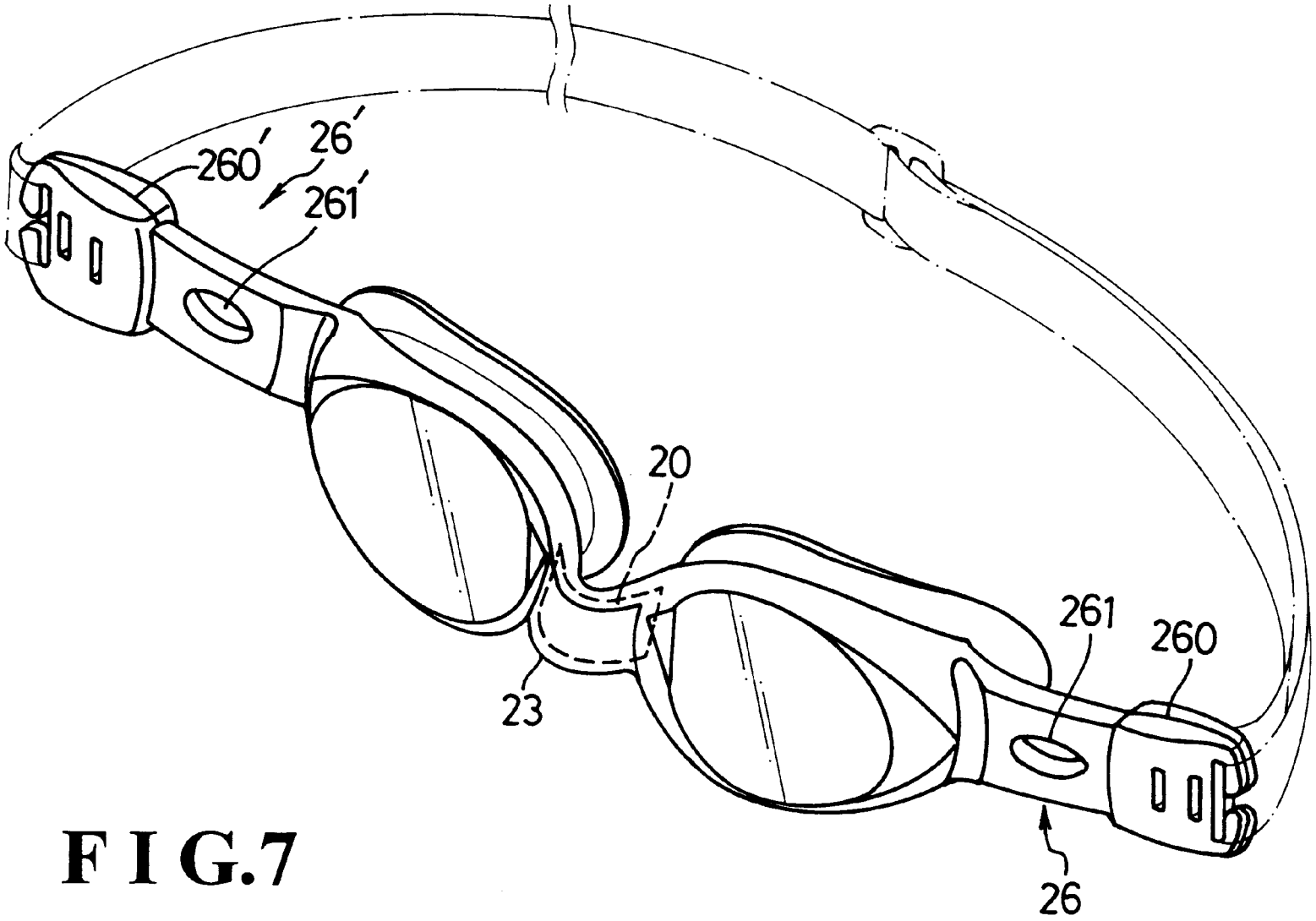
FIG. 7 is a perspective view showing a swimming goggle structure in accordance with a further embodiment of the present invention.
Figure 8:
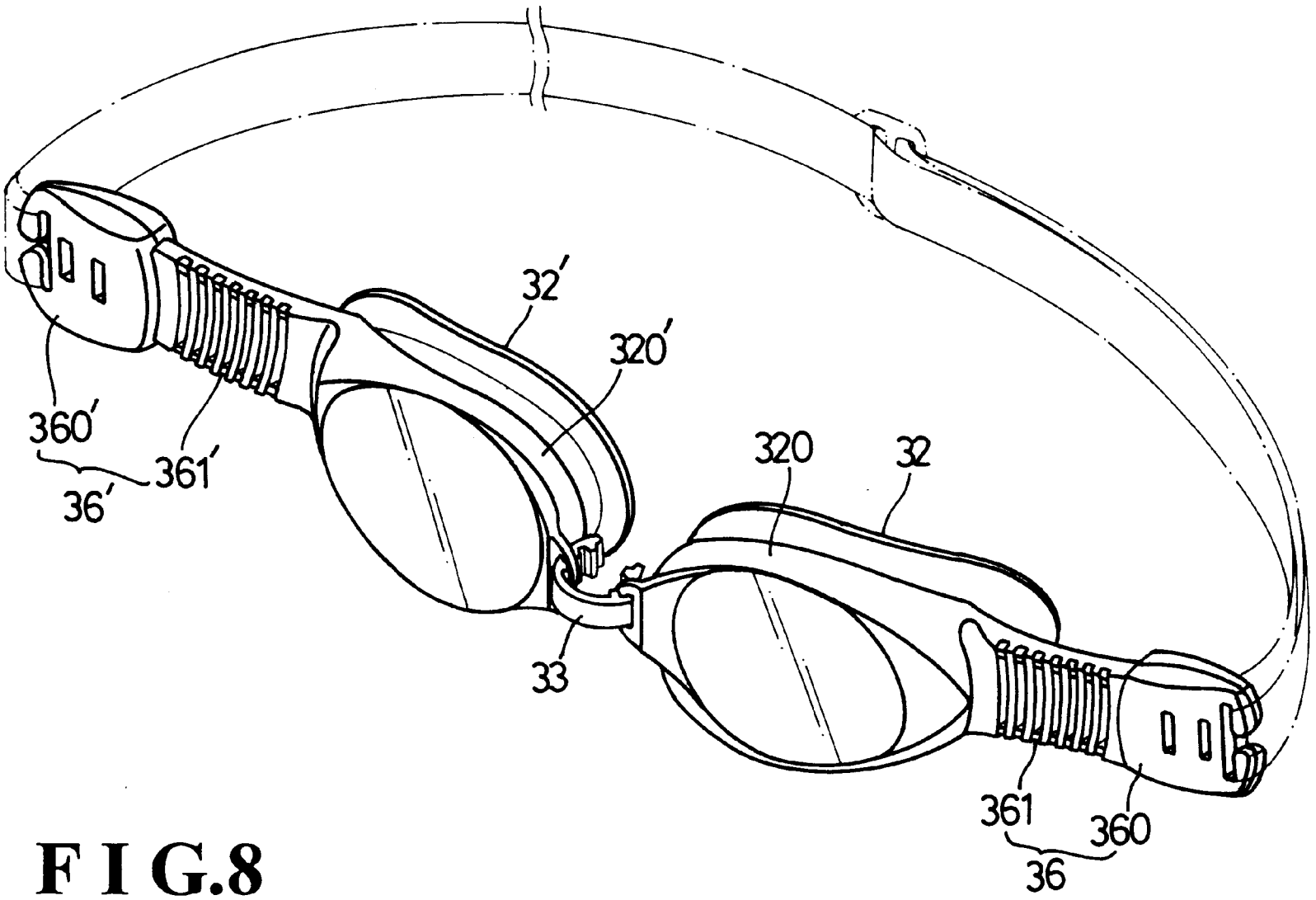
FIG. 8 is a perspective view showing a swimming goggle structure in accordance with a further embodiment of the present invention.

Referring to FIGS. 6–8, which show different embodiments of the present invention, the swimming goggle structures of all these embodiments include a rim face that is perpendicular to the lens and a rim flange to support and be enclosed by an enclosure section of the padding member, as discussed above, but in these embodiments, the bridge that is connects the two padding members and the strap fasteners that connect the strap to the padding members are modified.

In the embodiment of the swimming goggle structure which is designated with reference numeral 1" shown in FIG. 6, the oval hole formed on the anti-stretching member that is shown in the first embodiment discussed with reference to FIGS. 3, 4A and 4B is removed and instead, the swimming goggles of the embodiment of FIG. 6 is provided with an anti-stretching member 16" at each of the remote edges of the padding members which comprises a separate rear section to be secured to the remote edge of the padding member and having a plurality of passage apertures 1632" for the molding material to flow therethrough arranged in a line to replace the passages that are formed around the oval hole of the rear section of the strap fastener as shown in FIG. 3. The rear section of the anti-stretching member 16" also comprises a coupling portion 1631" having a slot or bore formed thereon (not shown in FIG. 6) to receive therein a securing button 1635" for engaging the strap 14".

In the embodiment of the swimming goggle structure shown in FIG. 7, a bendable member 20 (shown by dashed line in FIG. 7) is embedded in the bridge, which is now designated with reference numeral 23, connecting between the padding members of the swimming goggle structure. The bendable member 20 allows a wearer to deform the bridge 23 to suit the wearer's own face contour. The padding members are each provided with an anti-stretching member 26, 26' at the remote edge thereof and the anti-stretching member 26, 26' comprises an oval hole 261, 261' formed on an intermediate section thereof. The anti-stretching member 26, 26' also comprises a C-shaped coupling element 260 provided at the rear section thereof to engage the strap.

In the embodiment of the swimming goggle structure shown in FIG. 8, the bridge that connects between the padding members designated with reference numerals 32 and 32' is now designated with reference numeral 33 and is made as a separate member releasably attached to the padding members 32 and 32'. Further, the anti-stretching members 36 and 36' that are provided at remote edges of the padding members 32 and 32' are provided with vertical flutes on an intermediate section 361, 361' thereof. The anti-stretching member 36, 36' is provided at a rear section 360, 360' with a C-shaped coupling element for engaging a strap.

Quite obviously, from the embodiments discussed herein, it can be understood that the enclosing configuration of the padding members over the lens-rim members in accordance with the present invention is applicable to varied kinds of bridges and strap fastener to provide a comfortable adjustment of the swimming goggles in putting on the goggles.

It is apparent that although the present invention is illustrated with the description of the preferred embodiments, it is contemplated that there may be changes and modifications in the described embodiments that can be carried out without departing from the scope of the invention which is intended to be limited only by the appended claims.

What is claimed is:

1. A swimming goggle structure comprising:

a pair of lens-rim members, each comprising a lens and a rim integrally formed with a light transmitting material as a unitary structure, the rim comprising a rim face extending from and surrounding the lens and a rim flange extending from the rim face;

a padding member associated with each of the lens-rim members, comprising a closed ring-like enclosure section for engaging the rim flange and enclosing the rim face and a face contact section integrally formed with the enclosure section adapted to be in contact engagement with a wearer's face, each of the lens-rim members further comprises lens retainer means to securely retain the lens-rim member on the respective padding member;

a bridge for connecting the lens-rim members to each other; and a strap having two ends connected to the padding members, the strap is adapted to surround a wearer's head; wherein the lens retainer means comprises an inner device which is provided at a proximal edge of the lens-rim member that confronts the other lens-rim member and an outer device that is provided at an edge of the lens-rim member that is away from the other lens-rim member to respectively engage counterpart inner and outer devices formed on the padding member, both the inner and outer devices comprising a male element and both the inner and outer counterpart devices comprising a female element to receive and engage the male element.

2. The swimming goggle structure as claimed in claim 1, wherein the male element comprises a triangular extension from the rim and the female element comprises a triangular recess to receive therein the triangular extension.

3. The swimming goggle structure as claimed in claim 1, wherein the male element of the inner device of the lens retainer means comprises a triangular extension from the rim with a peg formed thereon extending toward the padding member and wherein the female element of the inner counterpart device of the lens retainer means comprises a triangular recess for receiving the extension therein and the recess having a bore formed thereon for receiving the peg therein.

4. The swimming goggle structure as claimed in claim 3, wherein each of the padding members comprises an anti-stretching member connected to the remote edge thereof, the anti-stretching member comprising an front section integrally extending from the padding member and a rear section having a strap fastener formed thereon for engaging the strap and an intermediate section integrally extending from the front section and connecting to the rear section, the intermediate section comprising means for providing flexibility of the anti-stretching member.

5. The swimming goggle structure as claimed in claim 4, wherein the bridge and the enclosure sections of the padding members are integrally formed together.

6. The swimming goggle structure as claimed in claim 5, wherein the bridge comprises a plurality of flutes extending in a direction substantially normal to a direction connecting the two padding members.

7. The swimming goggle structure as claimed in claim 5, wherein the bridge comprises a bendable member embedded therein.

* * * * *